US006925153B2

(12) United States Patent
Hilhorst

(10) Patent No.: US 6,925,153 B2
(45) Date of Patent: Aug. 2, 2005

(54) GRID ARRANGEMENT FOR X-RAY APPARATUS

(75) Inventor: Cornelis Hilhorst, Leusden (NL)

(73) Assignee: Hoorn Holland B.V., Leusden (NL)

( * ) Notice: Subject to any disclaimer, the term of this patent is extended or adjusted under 35 U.S.C. 154(b) by 112 days.

(21) Appl. No.: 10/432,239

(22) PCT Filed: Nov. 22, 2001

(86) PCT No.: PCT/NL01/00851

§ 371 (c)(1),
(2), (4) Date: Oct. 6, 2003

(87) PCT Pub. No.: WO02/43078

PCT Pub. Date: May 30, 2002

(65) Prior Publication Data

US 2004/0066905 A1 Apr. 8, 2004

(30) Foreign Application Priority Data

Nov. 22, 2000 (NL) ..... 1016674

(51) Int. Cl.[7] ..... G21K 1/00
(52) U.S. Cl. ..... 378/155; 378/154
(58) Field of Search ..... 378/154, 155

(56) References Cited

U.S. PATENT DOCUMENTS 1,948,270 A 2/1934 Liberson
4,096,391 A * 6/1978 Barnes ..... 378/155
4,760,589 A 7/1988 Siczek
4,901,335 A 2/1990 Ferlic et al.
5,291,539 A 3/1994 Thumann et al.
6,470,072 B1 * 10/2002 Johnson ..... 378/154

FOREIGN PATENT DOCUMENTS

EP 0 417 965 A2 3/1991

* cited by examiner

*Primary Examiner*—Craig E. Church
*Assistant Examiner*—Krystyna Suchecki
(74) *Attorney, Agent, or Firm*—Sughrue Mion, PLLC

(57) ABSTRACT

Grid arrangement (1) for use with an X-ray apparatus (70) that is provided with an X-ray source and a recording element, it being possible, in operation, to place the grid arrangement (1) against the recording element and the grid arrangement being equipped to accommodate a flat grid (3) that comprises a multiplicity of elongated thin lamellae. The lamellae are placed essentially parallel to one another in a direction parallel to one surface of the grid (3), and the lamellae are oriented towards a focal axis a specific distance above the surface of the grid (3). The grid arrangement (1) further comprises drive means (8) which are equipped to move the grid (3) in a pendulum movement essentially about an axis of rotation and adjustment means (4, 10) for adjusting the axis of rotation of the pendulum movement to match the focal axis of the grid (3).

12 Claims, 5 Drawing Sheets

Figure 1:
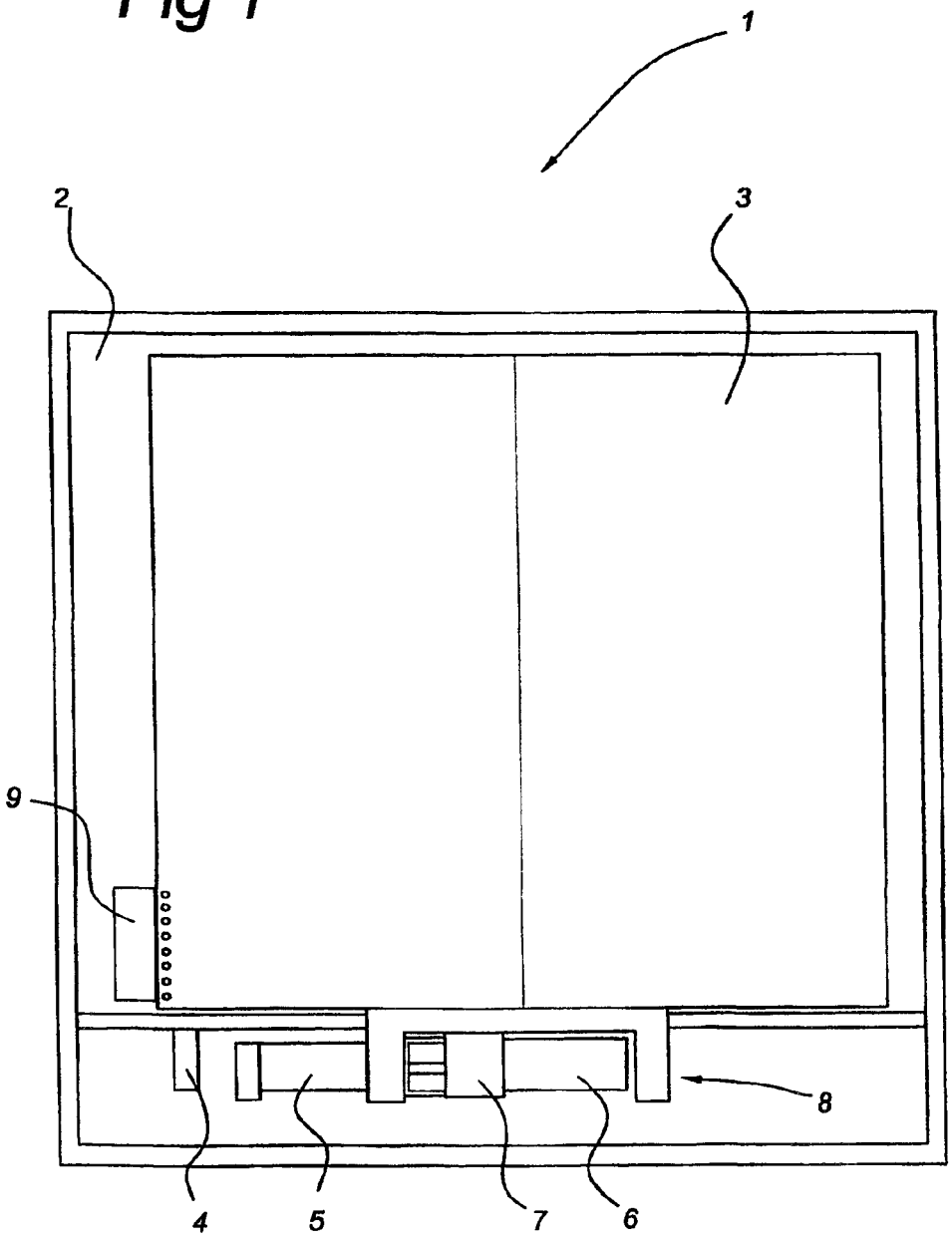

2
18
17
14
12
19
20
10
16
15
13
11

2
18
22
25
26
24
23
21
16

2
18
14
17
12
22
26
25
19
20
10
24
23
21
13
16
11
15

GRID ARRANGEMENT FOR X-RAY APPARATUS

The present invention relates to a grid arrangement for use with an X-ray apparatus that is provided with an X-ray source and a recording element, it being possible, in operation, to place the grid arrangement against the recording element and the grid arrangement being equipped to accommodate a flat grid that comprises a multiplicity of elongated thin lamellae, the lamellae being placed essentially parallel to one another in a direction parallel to one surface of the grid, and the lamellae being oriented towards a focal axis a specific distance above the surface of the grid, and the grid arrangement having drive means which are equipped to move the grid in a pendulum movement essentially about an axis of rotation.

U.S. Pat. No. 4,901,335 discloses a mammography device that is provided with an X-ray source and a recording element, for making diagnostic X-ray photographs. The mammography device is furthermore provided with a slot grid having a multiplicity of X-radiation absorbing lamellae that is positioned just above the recording element. The slot grid is in the form of a portion of a cylinder. The lamellae are aligned parallel to and radial with an axis of the cylinder, about which the grid turns in a pendulum movement. The axis, or the focal axis of the grid, is coincident with the X-ray source, as a result of which only X-radiation directly from the source, and not X-radiation that is scattered by the object to be examined, is allowed through. As a result of this a large proportion of the scattered radiation is blocked, which has an adverse influence on the contrast in the X-ray photographs.

This known mammography device has the disadvantage that it can be used only for a specific type of photographs where the distance between the X-ray source and the recording element is fixed. As a result of the cylindrical shape of the grid, the focal axis thereof is fixed. The device is provided with drive means for driving the cylindrical grid in a pendulum movement about the focal axis, which cylindrical grid can be used only for a single distance between X-ray source and recording element. If a different distance is required, such as occurs with X-ray equipment for general use, the grid and the grid drive means must be replaced. In general this is a costly matter.

The aim of the present invention is to provide a grid arrangement that is suitable for general use in various types of X-ray equipment and with various types of grids.

The present invention provides a grid arrangement of the type defined in the preamble, wherein the grid arrangement further comprises adjustment means for adjusting the axis of rotation of the pendulum movement to match the focal axis of the grid. Preferably the grid is in the shape of a flat plate, the focal axis of which is preferably between 100 cm and 250 cm away from the grid.

The focus-dependent pendulum movement makes it possible for the grid arrangement to be used in a universal X-ray apparatus that, for example, is equipped with a digital recording sensor. The grid can be changed, so that various distances between X-ray source and recording sensor are possible by fitting a grid having a longer focal axis distance. As a result of the use of the grid that makes a pendulum movement, it is possible to reduce the dose of X-radiation for a specific photograph without shadows of the grid or other artefacts being produced. Using a prototype of the grid arrangement in question it has proved possible to achieve a reduction in dose of 5 to 18 percent.

In one embodiment the grid arrangement further comprises a reading device for detecting how far the focal axis is above the grid, the reading device being connected to the adjustment means and the adjustment means being arranged to adjust the axis of rotation of the pendulum movement to match the detected focal axis of the grid.

In this embodiment the axis of the pendulum movement is automatically adjusted to the type of grid that has been placed in the grid arrangement. This reduces the risk of errors when adjusting the pendulum movement, which could render a new photograph (and thus an additional dose of X-radiation) necessary.

In a further embodiment the drive means comprise a first and a second adjustable body provided with a first and a second slot in which fixing means for the grid can be moved back and forth, the first and second slots making an obtuse angle with respect to one another. Preferably the obtuse angle is an angle of between 135° and 180°. Preferably, the first and second adjustable bodies for the grid arrangement are of dual construction and support the grid on two sides.

The pendulum movement is obtained by mounting the grid in the first and second slots. As a result of the pendulum movement the lamellae of the grid remain oriented towards the X-ray source, as a result of which less blockage of direct X-radiation occurs.

In a further embodiment the first and second adjustable bodies can be rotated about a first and, respectively, second pivot point, and the adjustment means further comprise an adjustment body having a longitudinal axis from a first end to a second end, which adjustment body is provided at the first and the second end with a first and, respectively, a second guide slot, which guide slots are essentially parallel to one another and make a first and, respectively, second angle with the longitudinal axis of the adjustment body, the first guide slot is fixed by a rotary coupling to the first adjustable body and the second guide slot is fixed by a further rotary coupling to the second adjustable body, in such a way that the obtuse angle between the first slot and second slot is changed by displacement of the adjustment body along the longitudinal axis.

What is achieved in this embodiment is that the angle between the first and the second slot, and thus the axis of the pendulum movement, is adjustable in a simple manner. The adjustment body can, for example, be driven by a simple controllable electric motor.

In yet a further embodiment the drive means comprise a drive drum having a guide track at the periphery of the drive drum, and a transmission that can be moved in the guide track and is coupled to the grid, the guide track having a shape such that a rotation of the, drive drum results in a back and forth movement of the grid over a certain distance.

This makes simple and inexpensive driving of the grid possible, with a low volume requirement.

A further embodiment of the present invention is constituted by a grid arrangement wherein the drive drum has an ejection track and a changeover device, the changeover device being arranged to connect the ejection track to the guide track on actuation. Preferably, the second slot has a first section and a second section, the first section forming the obtuse angle with the first slot and the second section making an angle with the first slot that is greater than the obtuse angle.

In this embodiment it is easily possible to place the grid in the grid arrangement in such a position that removal of the grid is very simple. As a result of the kink in the second slot, it is possible to move the grid a certain distance outside the grid arrangement without it being impeded by the housing of the grid arrangement. Changing the grid is important in particular if X-ray equipment that is equipped with a very expensive digital recording sensor is used. Because the grid can be changed, the X-ray equipment can be used in a wide range of applications.

Preferably, the drive means are provided with at least two rotary couplings with the grid on either side of the grid, and the two rotary couplings are joined to one another by a shaft.

Because the grid is driven on two sides, undesirable movements in the grid, which could lead to disturbances in the recorded image, will occur less readily. If a grid is used for general applications, with dimensions of 1.5 mm high, 43 cm wide and, for example, also 43 cm long, the weight of the grid is approximately 2.5 kg (for comparison: in a mammography installation the grid weighs approximately 350 gram). Setting such a grid in motion can rapidly lead to the said undesired movements.

In one embodiment the transmission between drive drum and grid comprises a first gear disc and a second gear disc, a toothed belt that is stretched tautly around the first and second gear discs, a first pawl provided with a pin for coupling to the guide track, the first pawl being rotatably connected to the toothed belt on one side of the first and second gear discs, and a second pawl provided with a rotary coupling for coupling to the grid, the second pawl being rotatably connected to the toothed belt on a second side of the first and second gear discs.

This embodiment of the grid arrangement makes a very compact construction possible. In a prototype of the grid arrangement all elements, including the 43 cm by 43 cm grid, are housed in a 520 mm by 575 mm housing which has a height of only 34 mm. As a result it is possible to use the grid arrangement for a wide variety of types of X-ray photographs, in all possible positions of the X-ray equipment. As a result of the small amount of space that is needed for the elements of the grid arrangement, it is possible to take photographs of a very large effective area. If, for example, a thorax photograph is taken, it is possible to place the X-ray equipment as close as possible to the patient's chin, an image of a large proportion of the patient's neck then also being obtained.

Figure 2A:
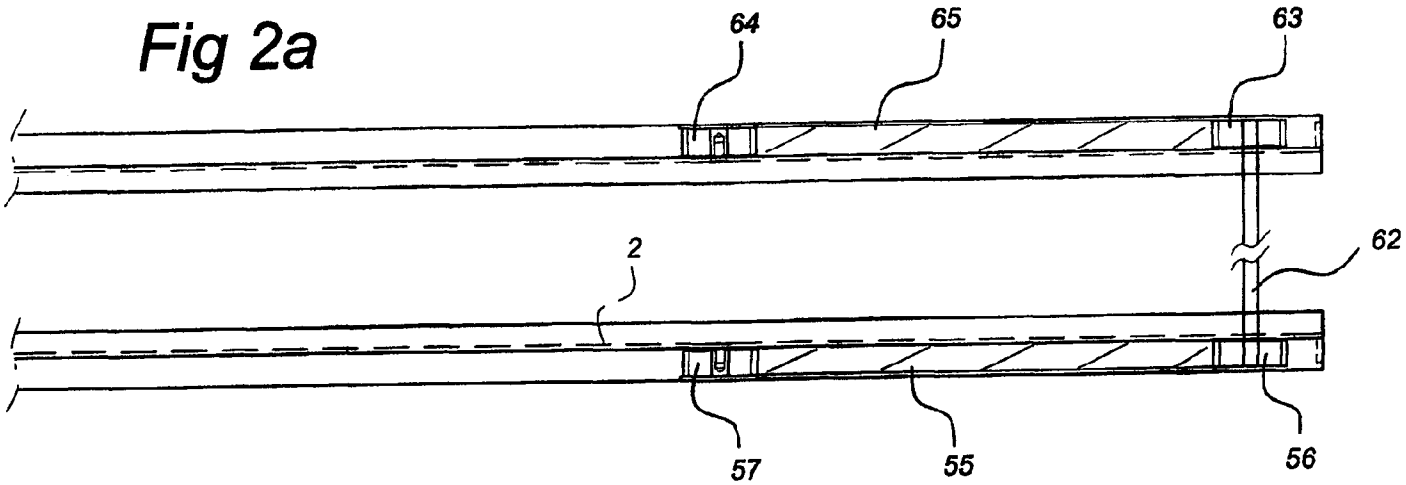
Figure 2B:
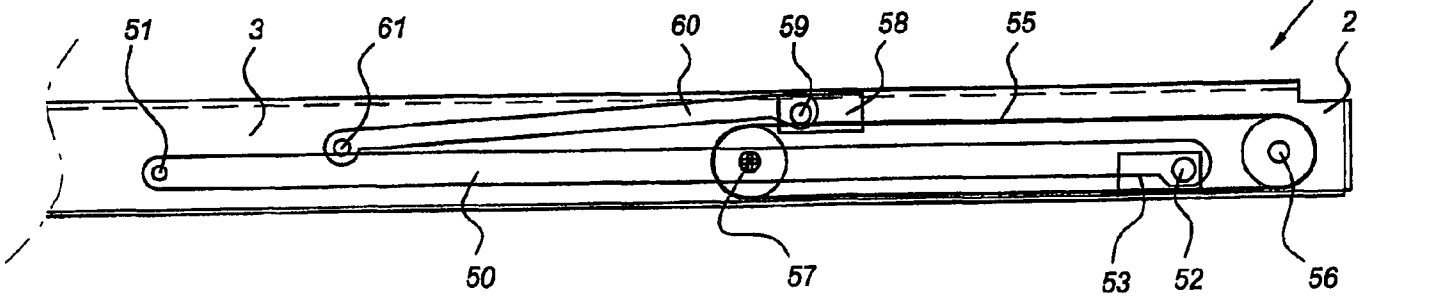

FIG. 1 shows a plan view of a grid arrangement according to a preferred embodiment of the present invention;

FIG. 2*a* shows a plan view of the grid drive in the grid arrangement according to the present invention;

FIG. 2*b* shows a side view of the grid drive in FIG. 2*a;*

Figure 3A:
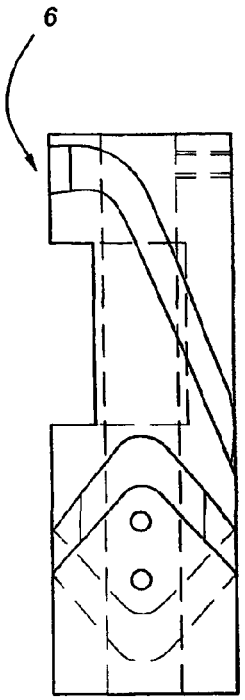
Figure 3B:
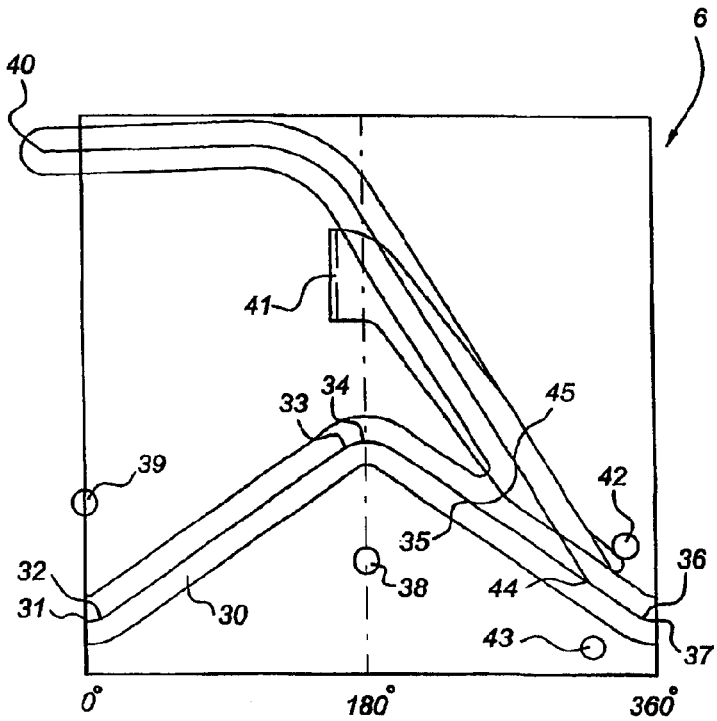

FIG. 3*a* shows a cross-sectional view of the drive drum of the grid arrangement according to the present invention;

FIG. 3*b* shows a flattened view of the entire periphery of the drive drum in FIG. 3*a;*

Figure 3C:
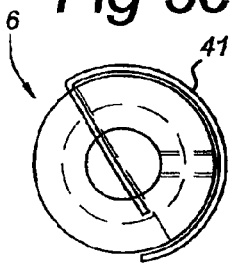

FIG. 3*c* shows a plan view of the drive drum in FIG. 3*a;*

Figures 4A, 4B, 4C:
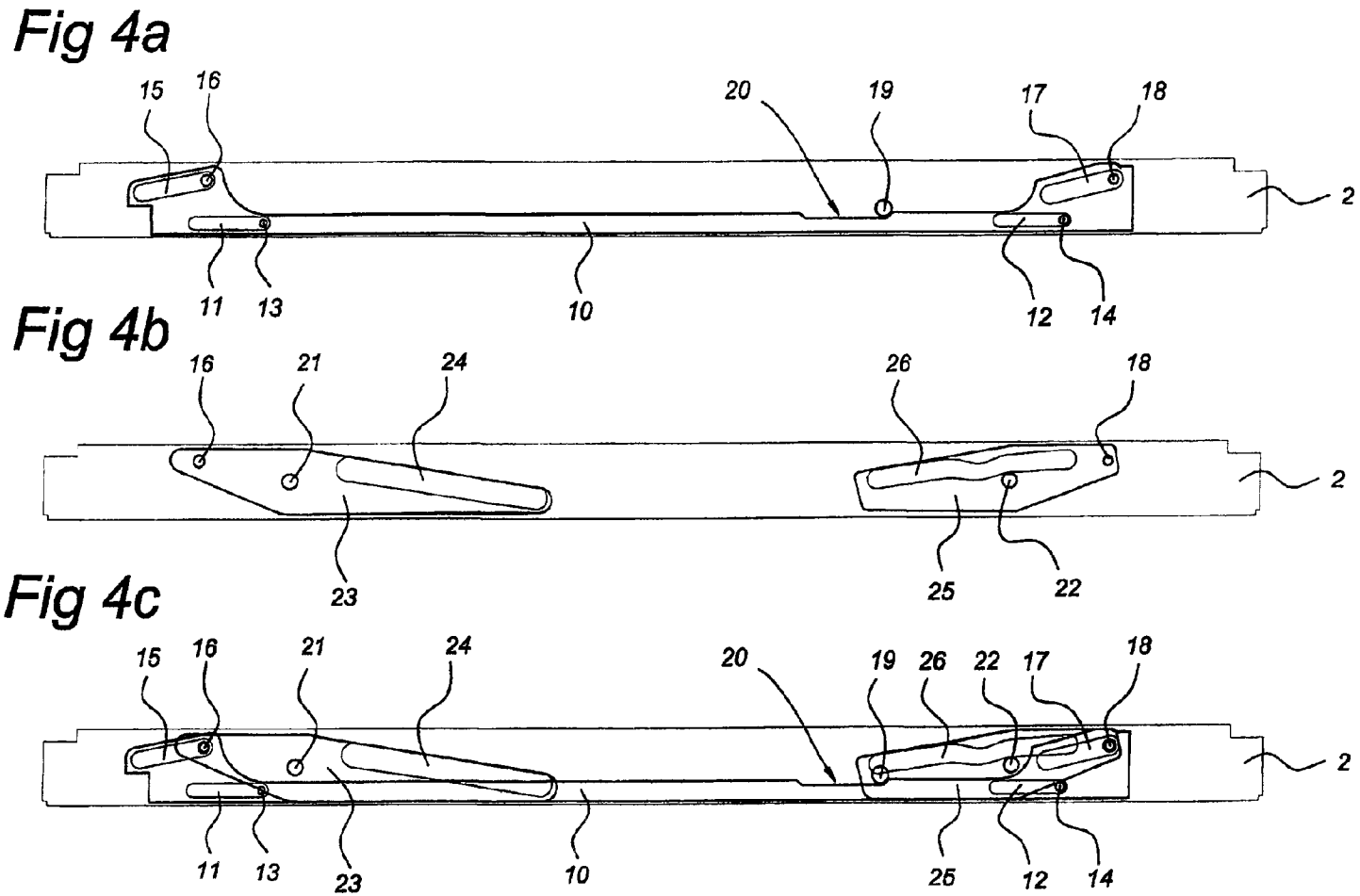
Figure 5:
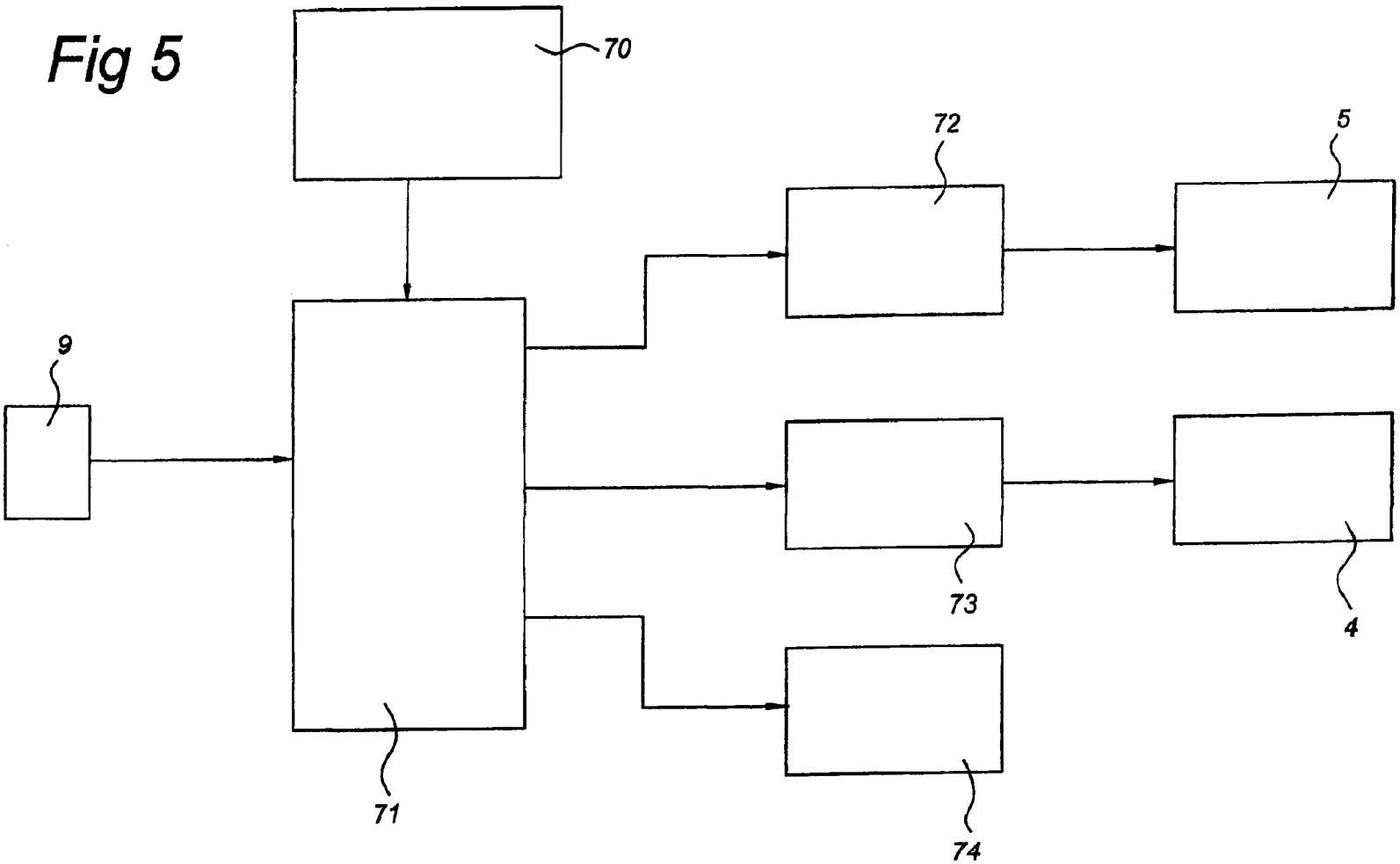

FIG. 4*a* shows a side view of the adjusting device that is used in the grid arrangement in FIG. 1;

FIG. 4*b* shows a side view of the means for obtaining a pendulum movement that are used in the grid arrangement in FIG. 1;

FIG. 4*c* shows a side view of the combination of the adjusting device and the means for obtaining a pendulum movement; and FIG. 5 shows, diagrammatically, the control of an embodiment of the grid arrangement according to the present invention.

A simplified plan view of a grid arrangement 1 according to a preferred embodiment of the present invention is shown in FIG. 1. The grid arrangement 1 is intended to be used in X-ray equipment, the grid arrangement 1 having to be positioned just above a recording element in the X-ray equipment. The recording element can be a (negative) film that is sensitive to the X-radiation used, or a digital recording element, such as a charge coupled device (CCD) or a flat array of detectors which are sensitive to X-radiation.

The grid arrangement 1 contains a grid 3 in the form of a flat plate, the grid 3 being provided with thin lamellae made of a material, such as lead, that is opaque to X-radiation. The remainder of the material of the grid 3 is transparent to X-radiation and imparts rigidity to the grid 3. The lamellae run essentially parallel to one another in a direction parallel to the flat side of the grid 3. The broad sides of the lamellae are oriented towards a certain axis a certain distance away from the top surface of the grid 3. As a result, elongated tunnels are produced which allow radiation that is incident essentially parallel to the lamellae to pass through and block radiation that is incident at somewhat of an angle. The portion of the radiation that is let through by the grid 3 is a function of the relationship between the thickness of the lamellae and the spacing between lamellae. Furthermore, said portion is dependent on the precision of the alignment of the lamellae. If the X-ray source of the X-ray equipment with which the grid 3 is used is positioned on said certain axis (or on the focal axis of the grid 3), radiation that passes through an object to be examined and is scattered by the object will not impinge on the recording element. Because no scattered X-radiation impinges on the recording element, the photograph will acquire greater contrast, as a result of which it is also possible to reduce the dose of X-radiation for a photograph.

In order to prevent shadows of the lamellae of the grid 3 falling on the recording element, the grid 3 is moved while an X-ray photograph is being taken. The grid arrangement 1 according to the present invention is equipped to allow the grid 3 to make a pendulum movement about the focal axis towards which the broad sides of the lamellae are oriented. As a consequence the lamellae remain oriented in the longitudinal direction towards the X-ray source and as little shadow as possible of the lamellae is cast onto the recording element. As a result of the movement no shadows of the lamellae are produced on the recording element while the photograph is being taken.

With the present grid arrangement 1 it is possible to reduce the dose required for a broad field of application of X-ray photographs. Depending on the application (distance between X-ray source and recording element, distance between and height of lamellae in grid 3) a reduction in dosage of between 5 and 18% can be obtained.

The grid 3 is placed in a grid housing 2 that during operation is placed directly on the recording element. The grid arrangement 1 further comprises elements for driving and controlling the grid 3. The grid 3 is driven by a drive device 8 that in the embodiment shown comprises a motor 5 (optionally with a reduction gear), as well as a drive drum 6 and a coupling 7. The drive device 8 is discussed in more detail below. The grid arrangement 1 is further provided with adjusting means 10, 23, 25 which are equipped to allow the grid 3 to make a pendulum movement, the axis of the pendulum movement being dependent on the focal axis of the grid 3. In the embodiment shown the adjusting means 10, 23, 25 are driven by a motor 4.

In a preferred embodiment the grid arrangement 1 is furthermore provided with an identification element 9 to identify the type of grid 3 that has been placed in the grid arrangement 1. Such an identification element 9 can, for example, be made up of a number of light sources and light detectors, which identify the type of grid 3 that is present on the basis of a pattern of holes made in the grid 3.

FIGS. 2*a* and 2*b* show, respectively, a plan view and a side view of part of the drive device for the grid 3. The pawl 50 (FIG. 2*b*) is driven via a fixing 51 (for example a sleeve bearing) by the drive drum 6 and the coupling 7, which are explained in more detail below. The movement of the pawl 50 is transmitted by a flexible fixing, made up of shaft 52 and block 53, to a toothed belt 55 that is tautly stretched around gear discs 56 and 57. On the other side of the toothed belt, a further flexible fixing, consisting of block 58 and pin 59, ensures that the back and forth movement is transmitted via pawl 60 and a further pin 61 to the grid 3. An identical mirrored drive device, but without the pawl 50 and associated flexible fixing 52, 53, with two further gear discs 63, 64 and a second toothed belt 65 (FIG. 2*a*), is arranged on the other side of the grid 3. A rigid shaft 62 is arranged between the gear discs 56 and 63, which rigid shaft 62 ensures that the drive forces from the drive device 8 engage on two sides of the grid 3. By this means the production of torsional movements or rotations in the grid 3 as a result of a single-sided drive of the grid 3 is prevented.

The drive drum 6 provides a back and forth movement of the pawl 50 that drives the grid 3. The mode of action of the drive drum 6 in the drive device 8 will now be explained with reference to FIGS. 3*a* to 3*c*.

The motor 5 drives the coupling 7 via the drive drum 6. FIG. 3*a* shows a plan view of the drive drum 6 and FIG. 3*b* shows a flattened view of the entire periphery of the drive drum 6. The drive drum 6 is provided with a track 30 in which the fixing 51 (for example a sleeve bearing) of the pawl 50 is retained (see FIG. 2*b*). The operating stroke in this track is the path along the points 31, 32, 33, 34, 36 and 37 (which is identical to point 31). The return points 33 and 36 are detected by means of magnetic detection of the points 38 and 39 (for example in the form of permanent magnets arranged at these locations), after which the rotation of the drive drum 6 can be stopped. The paths between the points 32 and 33, and between points 34 and 36, respectively, are linear, as a result of which an accurately controllable movement of the grid 3 can be obtained. In order to prevent disproportionate wear, one movement stroke is started at point 34 and the next movement stroke at point 31 (or 37).

The drive drum 6 is also provided with an ejection track 40 that can be used in order to allow the grid 3 to make a movement in the housing 2 such that the grid 3 can easily be removed at the right-hand side of the housing (see FIG. 1). In addition, the drive drum 6 is provided with ejection changeover 41 that can be moved in the axial direction of the drive drum 6. FIG. 3*c* shows a cross-sectional view of the drive drum 6, an embodiment of the ejection changeover 41 which is located along the periphery on the outside of the drive drum 6 being shown. The movement of the ejection changeover 41 can, for example, be obtained by means of an electromagnetic actuator (not shown).

The position of the ejection changeover 41 during normal operation, that is to say when taking X-ray photographs with the X-ray equipment, is shown in FIG. 3*b*. The end of the ejection changeover 41 is then restrained by a stop 42, and the track 30 is completely free for movement of the fixing 51 of the pawl 50 along the points 31, 32, 33, 34, 36 and 37. As soon as the points are moved downwards in the axial direction as far as the further stop 43, the fixing 51 will be pushed into the ejection track 40, via the point 44 in track 30 and point 45 in the ejection track 40, as far as the end of the ejection track 40. The final section of the ejection track 40 is curved back to some extent, so that it is possible to prevent the drive being pushed back. If the motor 5 is not actuated, the fixing 51 will remain at the end of the ejection track 40 as a result of this.

FIGS. 4*a* to 4*c* show a side view of the elements 10, 23, 25 which make it possible for the grid 3 in the grid arrangement 1 to execute a variable pendulum movement about the focal axis towards which the lamellae of the grid 3 are oriented. For clarity, individual elements are shown in FIGS. 4*a* and 4*b*, which individual elements are shown in the assembled state in FIG. 4*c*. The figures show the elements 10, 23, 25 on one side of the grid 3 in the housing 2. Comparable (but mirror image) elements 10, 23, 25 are also present on the other side of the grid 3. The grid 3 is mounted by means of, for example, sleeve bearings (not shown), in a first slot 24 of a first adjustable body 23 and in a second slot 26 of a second adjustable body 25 (see FIG. 4*b*; in total, the grid 3 is thus guided at four points). The first slot 24 and second slot 26 are at a certain angle with respect to the horizontal of the housing 2, the first slot 24 being at a positive angle and the second slot 26 at a negative angle, as a result of which the grid 3, when the latter is moved back and forth by the pawl 60 (see FIG. 2*b*) will make a pendulum movement about an axis determined by the distance between the mounting points of the grid 3 and the angle of the first and second slots 24, 26. The first adjustable body 23 is rotatably mounted about a first pivot point 21 and the second adjustable body 25 is rotatably mounted about a second pivot point 22. The pivot points 21 and 22 provide the fixing of the first and second adjustable bodies 23, 25 to the housing 2.

FIG. 4*a* shows the adjustment body 10 that is mounted in the housing 2 of the grid arrangement 1 and is able to move back and forth therein. This is made possible by the two guide slots 11, 12 and fixing points 13 and 14, respectively, on the housing 2. The adjustment body 10 is furthermore provided with a lowered section 20 over a certain length, which, in cooperation with a post 19 that is fixed to the housing, ensures that the adjustment body 10 is able to move back and forth over a certain distance. Furthermore, the adjustment body 10 is provided at the two ends with two adjustment slots 15, 17, which are both essentially parallel to one another. As a result of the relative positioning of the first and second adjustable bodies 23, 25, the associated pivot points 21, 22, first slot 24, second slot 26 and the adjustments slots 15 and 17, it is possible that the adjustment slots 15, 17 are not completely symmetrical.

The adjustment body 10 is connected to the first and second adjustable bodies 23, 25 by a first and a second pin connection 16, 18, respectively. If the adjustment body 10 is now moved from left to right (see FIG. 4*c*), the first and second adjustable bodies 23, 25 will rotate in opposing directions with respect to one another about the respective pivot points 21, 22. As a result the first and second slots 24, 26 of the first and second adjustable bodies 23, 25 will move into a position at a less sharp angle with respect to the horizontal of the housing 2. This has the effect that the grid 3 will make a pendulum movement about a focal axis that is located further away from the surface of the grid 3 than in the previous situation. The combination of the adjustment body 10 and the first and second adjustable bodies 23 , 25 therefore provides a smoothly adjustable adjustment of the axis of the pendulum movement of the grid 3.

In the embodiment of the second adjustable body 25 shown, the second slot 26 has a right-hand section having a smaller angle of inclination with respect to the horizontal of the housing 2 than does the left-hand section, as a result of which a sort of lowering results. This lowering makes it possible that when the grid 3 is moved to the farthest right position in the grid arrangement 1 in order to remove the grid 3, the right-hand end of the grid 3 moves slightly downwards, as result of which the grid can be removed more easily from the housing 2 of the grid arrangement 1.

In one embodiment the adjustment body 10 can be driven by a motor 4 (see FIG. 1) under the control of a signal originating from the identification element 9. Depending on the distance of the focal axis from the lamellae of the grid 3, the adjustment body 10 can be so adjusted that the pendulum movement of the grid 3 takes place about an axis that is essentially coincident with the focal axis of the lamellae of the grid 3.

The drive elements and adjustment elements of the present grid arrangement 1 can be fitted into a very small space inside the housing 2, as a result of which the dimensions of the housing 2 do not have to be much greater than the dimensions of the grid 3. This has the advantage that not many obstacles are produced which impede the taking of X-ray photographs. As a consequence of the construction of the grid arrangement 1 it is, for example, possible to take good thorax photographs by placing the housing 2 close to the patient's chin.

FIG. 5 shows, diagrammatically, the control of the grid arrangement 1 according to the present invention. Preferably, the grid arrangement 1 is equipped with processing means 71, such as a microcontroller, which are arranged to drive the grid 3 and to control the axis of the pendulum movement of the grid 3. The processing means 71 are connected to the identification element 9 in order to receive information relating to the type of grid 3 that is present in the grid arrangement 1. Furthermore, the processing means 71 are connected to X-ray equipment 70 in order to receive information relating to the taking of a photograph with the X-ray equipment 70.

The processing means 71 are connected to adjustment means 73 for adjusting the axis of the pendulum movement depending on the type of grid 3 that is present in the grid arrangement 1. To this end the adjustment means 73 are connected to the motor 4. The grid 3 is preferably driven in synchronisation with the control of the X-ray equipment, so that the grid 3 makes a pendulum movement while an X-ray photograph is being taken. To this end the processing means 71 are connected to a drive control 72 which drives the drive drum 6 via the motor 5. Furthermore, the processing means 71 are connected to an ejection drive 74 which, in turn, is connected to means for actuating the ejection changeover 41. After the photograph or a series of photographs has/have been taken, the processing means 71 can control the ejection drive 74 in order to actuate the changeover 41 on the drive drum 6 and also to control the drive control 72 in order to move the drive drum 6 in the correct direction, so that the grid 3 is brought into a position which simplifies removal of the grid 3.

What is claimed is:

1. Grid arrangement for use with an X-ray apparatus that is provided with an X-ray source and a recording element, it being possible, in operation, to place the grid arrangement against the recording element and the grid arrangement being equipped to accommodate a flat grid that comprises a multiplicity of elongated thin lamellae, the lamellae being placed essentially parallel to one another in a direction parallel to one surface of the grid, and the lamellae being oriented towards a focal axis a specific distance above the surface of the grid, and the grid arrangement having drive means which are equipped to move the grid in a pendulum movement essentially about an axis of rotation, wherein the grid arrangement further comprises adjustment means for adjusting the axis of rotation of the pendulum movement to match the focal axis of the grid.

2. Grid arrangement according to claim 1, wherein the grid is made as a flat plate.

3. Grid arrangement according to claim 1 or 2, wherein the focal axis of the grid is between 100 cm and 250 cm away from the grid.

4. Grid arrangement according to claim 1, wherein the grid arrangement further comprises a reading device for detecting how far the focal axis is above the grid, the reading device being connected to the adjustment means and the adjustment means being equipped to adjust the axis of rotation of the pendulum movement to match the detected focal axis of the grid.

5. Grid arrangement according to claim 1, wherein the drive means comprise a first and a second adjustable body provided with a first and a second slot in which fixing means for the grid can be moved back and forth, the first and second slots making an obtuse angle with respect to one another.

6. Grid arraignment according to claim 5, wherein the obtuse angle is an angle of between 135° and 180°.

7. Grid arrangement according to claim 5, wherein the first and second adjustable bodies can be rotated about a first and, respectively, second pivot point, the adjustable means further comprise an adjustment body having a longitudinal axis from a first end to a second end, which adjustment body is provided at the first and the second end with a first and, respectively, a second guide slot, which guide slots are essentially parallel to one another and make a first and, respectively, second angle with the longitudinal axis of the adjustment body, the first guide slot is fixed by a rotary coupling to the first adjustable body and the second guide slot is fixed by a further rotary coupling to the second adjustable body, in such a way that the obtuse angle between the first slot and second slot is changed by displacement of the adjustment body along the longitudinal axis.

8. Grid arrangement according to claim 5, wherein the second slot has a first section and a second section, the first section forming the obtuse angle with the first slot and the second section making an angle with the first slot that is greater than the obtuse angle.

9. Grid arrangement according to claim 1, wherein the drive means comprise a drive drum having a guide track at the periphery or the drive drum, and a transmission that can be moved in the guide track and is coupled to the grid, the guide track having a shape such that a rotation of the drive drum results in a back and forth movement of the grid over a certain distance.

10. Grid arrangement according to claim 9, wherein the drive drum has an ejection track and a changeover device, the changeover device being equipped to connect the ejection track to the guide track on actuation.

11. Grid arrangement according to claim 9, wherein the drive means are provided with at least two rotary couplings with the grid on either side of the grid, and the two rotary couplings are joined to one another by a shaft.

12. Grid arrangement according to claim 11, wherein the transmission between drive drum and grid comprises:

- a first gear disc and a second gear disc;
- a toothed belt that is stretched tautly around the first and second gear discs;
- a first pawl provided with a pin for coupling to the guide track, the first pawl being rotatably connected to the toothed belt on one side of the first and second gear discs; and
- a second pawl provided with a rotary coupling for coupling to the grid, the second pawl being rotatably connected to the toothed belt on a second side of the first and second gear discs.

* * * * *